US007033239B2

(12) United States Patent
Cunkelman et al.

(10) Patent No.: US 7,033,239 B2
(45) Date of Patent: Apr. 25, 2006

(54) FLUORESCENT LAMP AND METHOD FOR ATTACHING A BASE MEMBER TO AN END OF SAME

(75) Inventors: Gary T. Cunkelman, Dallastown, PA (US); Richard C. Laird, Richmond, KY (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/667,030

(22) Filed: Sep. 18, 2003

(65) Prior Publication Data

US 2004/0056581 A1 Mar. 25, 2004

Related U.S. Application Data

(62) Division of application No. 10/077,254, filed on Feb. 15, 2002, now Pat. No. 6,794,811.

(51) Int. Cl.
*H01J 9/00* (2006.01)

(52) U.S. Cl. ..... 445/26; 445/43

(58) Field of Classification Search ..... 445/26, 445/43, 44; 313/318.01–318.12, 25
See application file for complete search history.

(56) References Cited

U.S. PATENT DOCUMENTS

| | | | | |
|---|---|---|---|---|
| 3,602,759 | A * | 8/1971 | Evans | 313/112 |
| 4,276,102 | A * | 6/1981 | Schaeffer et al. | 156/85 |
| 4,804,886 | A * | 2/1989 | Nolan et al. | 313/489 |
| 5,173,637 | A * | 12/1992 | Sica | 313/489 |
| 5,536,998 | A * | 7/1996 | Sica | 313/489 |
| 6,078,136 | A * | 6/2000 | Sica | 313/493 |
| 6,406,167 | B1 * | 6/2002 | Bock | 362/376 |

FOREIGN PATENT DOCUMENTS

JP 59186227 A * 10/1984

* cited by examiner

*Primary Examiner*—Joseph Williams
(74) *Attorney, Agent, or Firm*—Carlo S. Bessone

(57) ABSTRACT

A fluorescent lamp includes a glass envelope having a sealed end portion, a base shell member of a cup-shape configuration adapted to engage the envelope end portion, and a collar of shrink wrap material disposed around the envelope end portion and sides of the base shell member, the shrink wrap material being shrunken and compressing against the envelope end portion and the base shell member, to fix the base shell member on the envelope end portion.

9 Claims, 2 Drawing Sheets

FLUORESCENT LAMP AND METHOD FOR ATTACHING A BASE MEMBER TO AN END OF SAME

This is a division application Ser. No. 10/077,254, filed Feb. 15, 2002, now U.S. Pat. No. 6,794,811.

BACKGROUND OF THE INVENTION

1. Field of the Invention

The invention relates to fluorescent lamps, and is directed more particularly to a base for such lamps.

2. Description of the Prior Art

In the manufacture of lamps, a lamp envelope is usually provided with at least one base. Generally, a lamp base comprises a rigid shell secured to an end portion of the lamp envelope. At least one insulating disk is fixed in the shell for carrying one or more hollow base pins, or contacts, into which the lamp lead wires are electrically secured. The lamp is supported by one or more holders, or sockets, into which the lamp bases extend for communication with a source of electrical energy.

Typically, such lamp bases are secured to the end portions of the lamp envelope by means of a cement which is applied to the inside surface of a base shell annular wall. A sufficient quantity of cement is used to fill a gap between a lamp seal and the annular wall of the base. During manufacturing, each base is first fitted loosely onto a respective end portion of the lamp envelope. Thereafter, the cement is cured, as by heating, which allows the base to adhere to the lamp bulb and withstand industry torque requirements.

While the above technique of securing the lamp base by means of a suitable cement has been employed successfully in many lamp families, including fluorescent, it has been found that certain disadvantages exist. For example, the cement not only adds cost to the lamp but also requires the need for a separate process of applying the raw cement to the base shell. Moreover, while present manufacturing facilities using such a technique are equipped with machines which dispense cement, the machines require constant monitoring and periodic mechanical and electrical maintenance. Another disadvantage is the curing process of the cement, wherein indirect natural gas flame heat is used to cure the basing cement after the base is fitted to the end of the lamp. The temperatures required to cure the cement sometimes cause damage in the seal area of the lamp envelope. In addition, the machinery needed to provide the heat for curing not only requires periodic maintenance but also takes up valuable floor space in the production line.

Various alternatives for securing the base to the lamp end with little or no cement, or other type of adhesive, have been proposed in the past. For example, U.S. Pat. No. 2,993,191, which issued on Jul. 18, 1961 to Pietzsch et al, discloses a base for an electric discharge lamp wherein the base is constructed from resin having a modulus of elasticity which is greater than 5,000 kg./cm.$^2$ and as high as about 19,000 kg./cm.$^2$. The resin has a breaking dilation of more than 50% and as high as about 230% and has an initial softening temperature of as low as about 150° Celsius and as high as about 210° Celsius. In one embodiment, the base of Pietzsch et al is positioned with the annular wall adjacent to the trough of a bulb end which has been heated to about 330° to 350° Celsius. As a result, the base material melts and occupies the trough or channel and, by reason of the character of the material of which the base is composed, adheres to the surface of the glass bulb. Alternatively, the base may be pressed against the bulb end to cause an annular rib or reinforcement to snap over the bead or rim and into a trough or channel of the bulb without heating the bulb neck.

U.S. Pat. No. 4,221,453, which issued to Wagener on Sep. 9, 1980, discloses a base for a fluorescent lamp. The base comprises a frontal portion, contact pins electrically connected to the connecting wires, at least one drop of glue which dries at room temperature, and an annular wall extending circumferentially from and perpendicular to the frontal portion. The annular wall has at least two equally circumferentially spaced knobs protruding inwardly. The base is formed from an elastic, bendable thermoplastic material so that when the base is fitted to the tube over the end portion, the annular wall elastically deforms and the knobs slide over the collar and snap into the groove of the lamp end portion. To safeguard against rotary movement of the base relative to the bulb, the base is formed with radial ribs to be disposed in notches provided in the bulb neck.

U.S. Pat. No. 5,432,400, which issued Jul. 11, 1995 to Spaulding et al, discloses a lamp including a glass envelope having a base fitted at each end portion thereof. Each lamp base includes a metallic base shell having an annular flange. The annular flange is heated prior to fitting over the end portion of the envelope so as to increase the inner flange diameter. Cooling of the annular flange after fitting reduces the flange diameter, thereby providing an interference fit with the end portion. The lamp base is retained on the end portion without the need for basing cement. In order to accommodate variations in the diameter of the lamp seals, an annular rib is formed on the inner surface of the flange. After cooling, the annular rib forms an interference fit with the lamp end portion.

While the bases described in the above patents appear to be satisfactory from a functional standpoint, it is believed that unanticipated production and/or other related problems, as well as material cost, may explain why such bases have not been commercially successful. Accordingly, it is deemed advantageous to provide another viable alternative.

SUMMARY OF THE INVENTION

An object of the invention is, therefore, to provide a fluorescent lamp in which each base is fixed to a lamp envelope end in a manner requiring little machinery, reduced time, and greatly reduced costs.

A further object of the invention is to provide a method for attaching a base member to an end of a lamp envelope, which method is relatively simple and easily accomplished with little machinery, and reduced time and costs.

With the above and other objects in view, as will hereinafter appear, a feature of the present invention is the provision of a fluorescent lamp comprising a glass envelope having an end portion, and a base shell member of a cup-shape configuration adapted to engage the envelope end portion. A collar of shrink wrap material is disposed around the envelope end portion and sides of the base shell member, the shrink wrap material being shrunken and compressing against the envelope end portion and the base shell member, to fix the base shell member on the envelope end portion.

In accordance with a further feature of the invention, there is provided a method for attaching a base member to an end of a fluorescent lamp glass envelope. The method comprises the steps of providing an annular end portion on a wall portion of the glass envelope, and pressing a base shell member of a cup-shape configuration onto the end portion of the envelope. Further steps include applying a collar of shrink wrap material to the envelope end portion and the base shell member, and shrinking the collar to compress against the envelope end portion and the base shell member, to fix the base shell member on the envelope end portion.

In accordance with a still further feature of the invention, there is provided a fluorescent lamp comprising a glass envelope having an end portion and a base shell member of a cup-shape configuration adapted to engage the envelope end portion. A collar of wrap material is disposed around the envelope end portion and sides of the base shell member, an adhesive is disposed on an interior surface of the collar, the adhesive being contiguous with the glass envelope end portion and the base shell member, to fix the base shell member on the envelope end portion.

In accordance with a still further feature of the invention, there is provided a method for attaching a base member to an end of a fluorescent lamp glass envelope, the method comprising the steps of providing an annular end portion on a wall portion of the glass envelope, pressing a base shell member of a cup-shape configuration onto the end portion of the envelope, and applying a collar of wrap material to the envelope end portion and the base shell member, the wrap material having an adhesive on an interior surface of the collar, to fix the base shell member on the envelope end portion.

The above and other features of the invention, including various novel details of construction and combinations of parts and method steps will now be more particularly described with reference to the accompanying drawings and pointed out in the claims. It will be understood that the particular devices and method steps embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENTS

Figure 1:
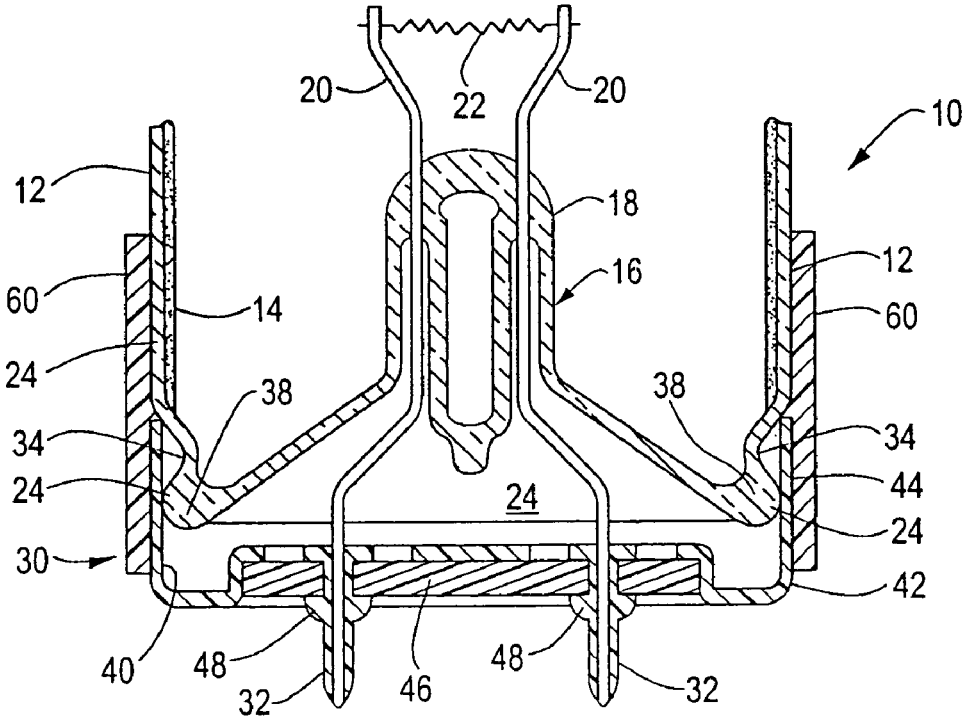
FIG. 1 is a side elevational, partly sectional, view of an end portion of a fluorescent lamp, showing one form of base member attachment to the lamp envelope, illustrative of an embodiment of the invention.

Referring to FIG. 1, it will be seen that a fluorescent lamp 10 comprising a tubular vitreous or glass envelope 12 is provided with an inner coating of phosphor 14 and is hermetically sealed at each end by a glass mount 16. Each mount 16 includes a stem press 18 within which a pair of lead wires 20 are sealed. A thermionic electrode 22 is mounted on the inner ends of lead wires 20 within the tubular glass envelope 12. Each thermionic electrode 22 comprises a tungsten coil coated with an emissive material of alkaline earth oxides.

In accordance with standard lamp-making practices, the envelope 12 is filled with a suitable starting gas and doped with mercury to provide an ionizable medium within the sealed envelope, which permits an electric discharge to pass between the thermionic electrodes.

Each end portion 24 of the lamp envelope 12 may include an annular groove 34 which terminates at an annular rim or seal 38. Each of the sealed end portions 24 of envelope 12 is fitted with a base 30 that includes a pair of axially-extending metal base pins 32, or other form of contacts, which serve as terminals for the lamp 10 and are adapted, by virtue of their spacing and dimensions, to permit the lamp to be inserted into the socket components of a lighting fixture and be operated from a suitable electrical power supply. Each lead wire 20 extends through the stem press 18 in mount 16 to a respective metal base pin 32.

Base 30 includes a metallic base shell 42 having an annular flange 44. When the base 30 is secured to the lamp end portion in a manner to be described below, an inner surface 40 of the annular flange 44 contacts the lamp end portion 24 and when the end portion includes the seal 38, contacts the annular seal 38. Base shell 42 is formed of a suitable metal, such as aluminum. The base shell 42 may be provided with an inwardly-directed annular ridge (not shown) for engaging the groove 34.

A disk 46 of insulating material is secured to base shell 42. The base pins 32 are received in registering apertures formed in the insulating disk 46. Each of the base pins 32 is provided with a flange portion 48 engaging the lower surface of disk 46, the base pin inner ends being swaged or riveted into contact with the upper surface of disk 46, thus rigidly securing the pins in position.

While the base 30 is shown including two base pins, any number of pins may be used depending upon the type of lamp. While only one insulator disk is used in the base illustrated, each base pin may be mounted on separate insulating disks.

To secure the base shell 42 to the envelope 12, the base shell member 42 is pressed onto the end portion 24 of the envelope 12. A collar 60 of shrink wrap material is fitted around the annular end portion 24 of the envelope 12, and around the flange 44 of the base shell member 42. The collar 60 is shrunken, as by the application of heat, to compress against the envelope end portion 24, and the base shell member flange 44, to urge the shell member flange 44 against envelope end portion 24, including the seal 38, if present, to fix the base shell member 42 on the envelope end portion 24.

Figure 2:
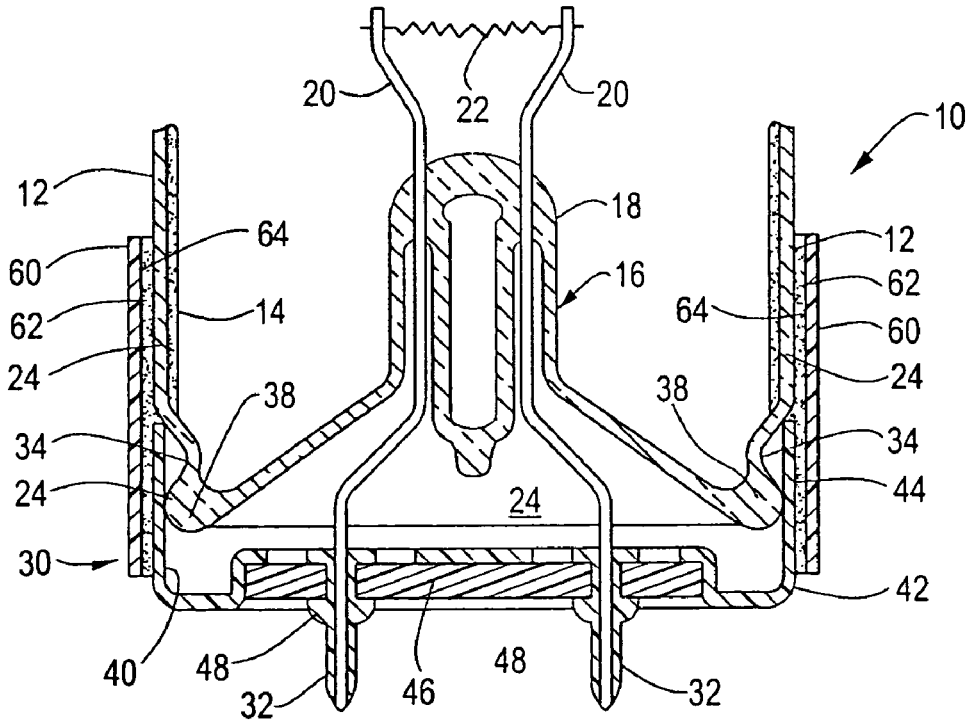
FIG. 2 is similar to FIG. 1, but illustrative of an alternative embodiment.
Figure 3:
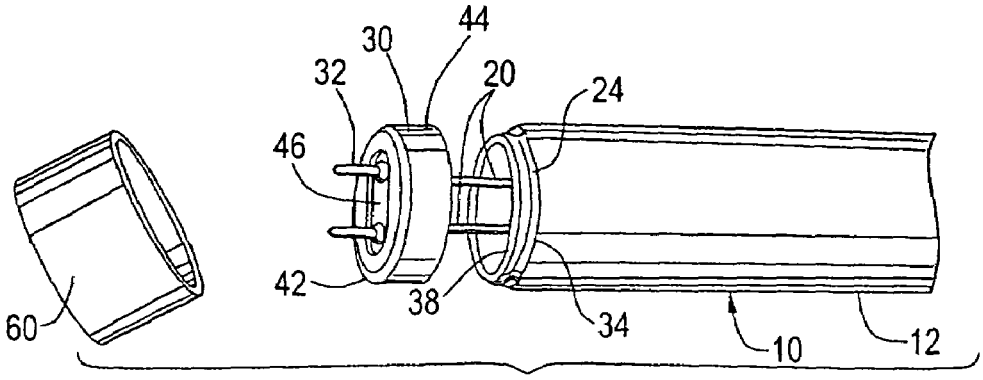
FIGS. 3 and 4 are exploded perspective views of the components of the base member attachment means of FIGS. 1 and 2.
Figure 4:
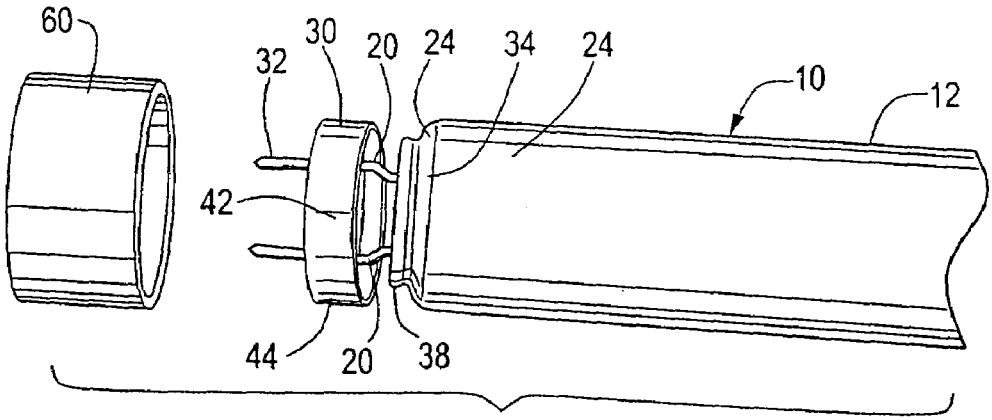
Figure 5:
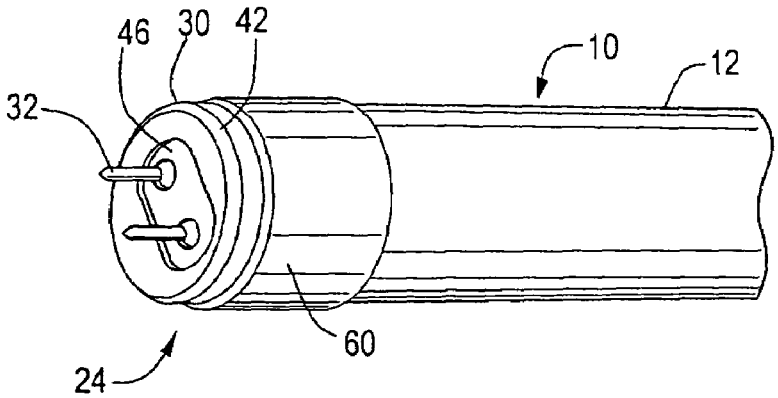
FIG. 5 is a perspective view of the assembled components of the base members attachment means of FIGS. 1–4.

Alternatively, or in combination with the above, the collar 60 may be provided with a layer of adhesive 62 (FIG. 2) on an interior surface 64 thereof. In this embodiment, the collar 60 is adhered to the glass envelope end portion 24 and the base member flange portion 44, with which the adhesive 62 is contiguous, to fix the base shell member 42 on the envelope end portion 24. The adhesive 62 may be heat curable, in which case the adhesive is cured by the application of hot air, or the like, to bond with the envelope end portion 24 and the base shell flange 44 to fix the shell member 42 on the glass envelope end portion 24.

There is thus provided a fluorescent lamp in which a base member is fixed to a lamp envelope end portion in a manner and by way of a method requiring little machinery, and reduced time and costs relative to prior methods.

It will be understood that many additional changes in the details, materials, steps and arrangement of parts, which have been herein described and illustrated in order to explain the nature of the invention, may be made by those skilled in the art within the principles and scope of the invention as expressed in the appended claims.

What is claimed is:

1. A method for attaching a base member to an end of a fluorescent lamp glass envelope, the method comprising the steps of:

providing an annular end portion on an external wall portion of the glass envelope;

pressing a base shell member of a cup-shape configuration onto the end portion of the envelope;

applying a collar of shrink wrap material to the envelope end portion and the base shell member, said collar having an adhesive on an interior surface thereof; and shrinking the collar to compress against the envelope end portion and the base shell member whereby the adhesive contacts the envelope end portion, to fix the base shell member on the envelope end portion.

2. The method in accordance with claim 1 wherein the adhesive is curable adhesive and the method includes a further step of curing the adhesive after applying the collar to the envelope end portion and the base shell member.

3. The method in accordance with claim 2 wherein the adhesive is cured by the application of heat and the collar is shrunken by the application of heat.

4. The method in accordance with claim 1 wherein shrinking the collar comprises applying heat to the collar to heat shrink the collar.

5. A method for attaching a base member to an end of a fluorescent lamp glass envelope, the method comprising the steps of:

providing an annular end portion on a wall of the glass envelope;

pressing a base shell member of a cup-shape configuration onto the end portions of the envelope; and applying a collar of wrap material to the envelope end portion and the base shell member, the wrap material having a layer of adhesive on an interior surface thereof to contact the envelope end portion and fix the base shell member on the envelope end portion.

6. The method in accordance with claim 5 wherein the adhesive is curable adhesive and the method comprises a further step of curing the adhesive after applying the collar to the envelope end portion and the base shell member.

7. The method in accordance with claim 6 wherein curing the adhesive comprises heat curing the adhesive.

8. The method in accordance with claim 5 wherein the collar is of a shrink wrap material and the method comprises a further step of shrinking the collar onto the envelope end portion and the base shell member.

9. The method in accordance with claim 8 wherein shrinking the collar comprises heat shrinking the collar.

* * * * *